US006129001A

United States Patent [19]

Harju

[11] Patent Number: 6,129,001

[45] Date of Patent: Oct. 10, 2000

[54] METHOD AND VALVE APPARATUS FOR CONTROLLING A RECIPROCATABLE FLUID ACTUATED POWER MACHINE

[75] Inventor: Bert Harju, Harads, Sweden

[73] Assignee: Pos-Line AB, Harads, Sweden

[21] Appl. No.: 09/043,652

[22] PCT Filed: Oct. 2, 1996

[86] PCT No.: PCT/SE95/01115

§ 371 Date: Sep. 3, 1998

§ 102(e) Date: Sep. 3, 1998

[87] PCT Pub. No.: WO97/13073

PCT Pub. Date: Apr. 10, 1997

[51] Int. Cl.[7] ..... F15B 15/22

[52] U.S. Cl. ..... 91/397; 91/399; 91/400; 91/404

[58] Field of Search ..... 91/397, 398, 399, 91/400, 404, 405, 406

[56] References Cited

U.S. PATENT DOCUMENTS

| | | | |
|---|---|---|---|
| 3,653,299 | 4/1972 | Howard . | |
| 4,104,899 | 8/1978 | Pinkstaff | 91/404 |
| 4,581,893 | 4/1986 | Lindbom | 60/413 |
| 4,608,910 | 9/1986 | Levenez et al. . | |
| 4,763,560 | 8/1988 | Sasaki | 91/403 |
| 4,932,311 | 6/1990 | Mibu et al. | 91/404 |

FOREIGN PATENT DOCUMENTS

| | | |
|---|---|---|
| 32 11 232 A1 | 11/1982 | Germany . |
| 392 674 | 5/1991 | Germany . |

*Primary Examiner*—F. Daniel Lopez
*Attorney, Agent, or Firm*—Larson & Taylor

[57] ABSTRACT

A method and an apparatus for controlling the function of all kinds of reciprocable power machines which are actuated by pneumatic, hydraulic of any other pressure fluid, irrespective if the machines are of rotary or axially operating type, in which the active power stroke is accomplished using full power of pressure fluid against a reciprocatable piston (2) in the active air pressure chamber (10, 12), and in which the reversing of the direction of operation is made by alternatingly supplying pressure fluid to the opposite air pressure chamber (12, 10) of the machine. A valve poppet (6) having several channels alternately places one of the pressure chambers (10, 12) of the reciprocatable fluid actuated machine (1, 2) under full pressure, builds up a certain counter pressure in a pressure chamber which is, at the actual moment, inactive, and evacuates the pressure from an inactive pressure chamber of the fluid actuated machine.

18 Claims, 5 Drawing Sheets

F. Soft stopping phase (direction ←)

G. Turning phase (direction ↻)

Figure 1:
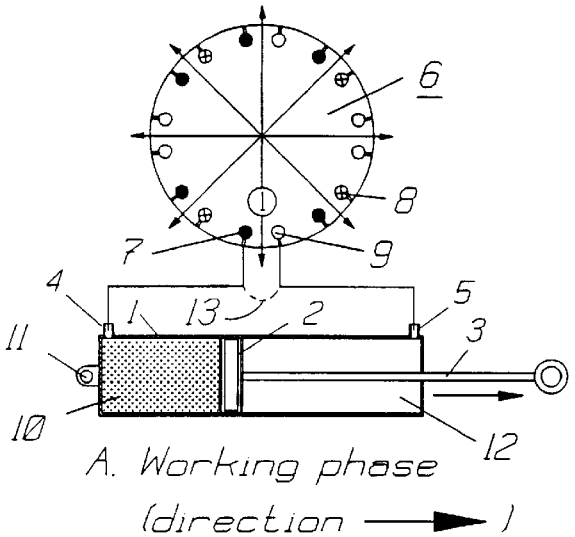

D. Soft starting phase
(direction ⟵)

E. Working phase
(direction ⟵)

F. Soft stopping phase
(direction ⟵)

G. Turning phase (direction ↻)

H. Soft starting phase (direction →)

Working pressure

Damping Pressure

Atmospheric pressure

METHOD AND VALVE APPARATUS FOR CONTROLLING A RECIPROCATABLE FLUID ACTUATED POWER MACHINE

The present invention relates to a method and an apparatus for controlling the function of a reciprocatable fluid actuated power machine. By fluid actuated power machine is meant, in this connection, all kinds of reciprocatable machines which are actuated by means of compressed air, hydraulic oil or any other fluid, irrespective if said machines are of rotatably or axially operating type, and which can execute its power in two opposite directions, or the machine executes its power in one direction only followed by a return movement without power execution, and whereby the reversing of direction is made by reversing the direction of the compressed air or the hydraulic fluid in the active part of the machine. So, the invention is useful both for single acting and double acting reciprocatable fluid actuated power machines.

In the following the invention will mainly be discussed in connection to pneumatically operated cylinder-piston units. It is, however, to be understood that this is only illustrative examples which do not restrict the invention. Be it known that the invention is as well useful both for linearly operated machines as for rotating machines and for machines operated by compressed air, hydraulic oil or any other fluid.

There are three basic problems of known reciprocatable pneumatic and hydraulic machines both of the single acting and of the double acting type, which problems form basis of the present invention. Said problems appear to the same extent both in rotary operating machines as in axially operating, reciprocatable machines, generally referred to as "compressed air cylinders" or "hydraulic cylinders", but for the sake of simplicity, as mentioned above, the invention will be described in the following only with reference to a pneumatic piston/cylinder unit of reciprocatable type.

All three different main problems, which appear in reciprocatable, pneumatic power machines, are related to the reversing phase, during which phase the active part of the machine, in the described case the compressed air piston, is to reverse its direction of operation. This is made in that the compressed air is switched from having acted on one side of the piston to acting against the opposite side of the piston.

When reversing the direction of function in previously known apparatus the compressed air is evacuated from the side of the piston which is the active side until the moment of reversal in that the pressurised working chamber is evacuated at the same time as compressed air is supplied to the opposite side of the piston:

1) firstly, this makes the often very strongly compressed air pressure at the unloading phase create an air blow which is received as an oftenly very high sound or bang, which can be very disturbing;
2) secondly, depending on the momentary draining of the pressure in the air chamber which has so far been pressurised, some amount of compressed air gets lost; such loss of compressed air means an economical loss of value considering the costs and the work for producing said compressed air;
3) thirdly, at the same time as one of the compressed air chambers is being evacuated and the opposite compressed air chamber is pressurised by means of the oftenly high air pressure, the piston is immediately or momentarily stopped and momentarily thereafter starts moving in the opposite direction with high speed and high power. This may in some cases cause problems. Said problem also appears in hydraulically operated machines.

Still another problem in pneumatic power machines is to have the active part thereof, generally the piston, stop in a predetermined position. A main reason for this problem is the compressibility of the air.

In single acting reciprocatable cylinders the power stroke is made by means of compressed air, whereas the return movement is generally accomplished by means of return spring. In order to overbridge the power of the return spring it is necessary to make use of a substantially stronger power of the compressed air or the hydraulic fluid than would have been needed if the cylinder had no return spring.

The object of the invention therefore is to eliminate all of the above mentioned problems and disadvantages by suggesting a simple method and a simple type of valve arrangement, and thereby to suggest a method and an apparatus in a reciprocatable, single or double acting fluid actuated power machine:

a) which to a high extent reduces the noise which is created at the evacuation of the air pressure when the active part of the power machine reverses its operation direction;
b) which makes it possible to save at least 30–50% of compressed air of the previously needed amount of fluid;
c) which makes the active part of the pneumatic or hydraulic power machine both stop and start relatively softly during the reversing phase;
d) and which makes it possible to stop the piston movement rather exactly at any point of the piston/cylinder unit.

According to the invention this is generally accomplished in that the piston of the fluid actuated machine meets a counter pressure both at the end of an active power stroke and at starting of a power stroke in the opposite direction. The soft braking preferably is made in that the two sides of the fluid actuated machine are interconnected over a shunt shortly before the active part of the machine (the piston) reaches the end of its active stroke whereby the piston softly becomes braked. The shunting, or the equalization of the compressed air can be made in several successively increased stages, using mechanical or other types of pressure restricting valves to complete equalization of power at both sides of the piston.

Figure 5:
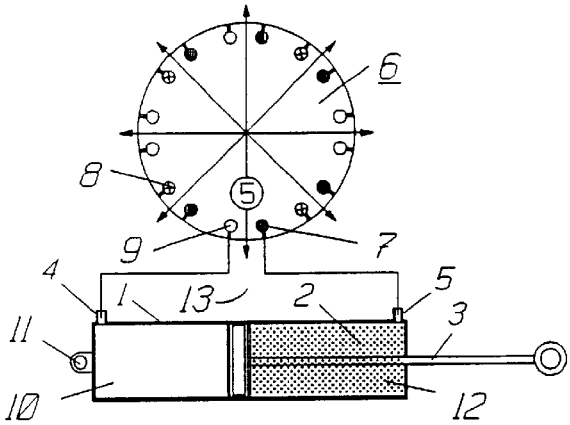
Figure 6:
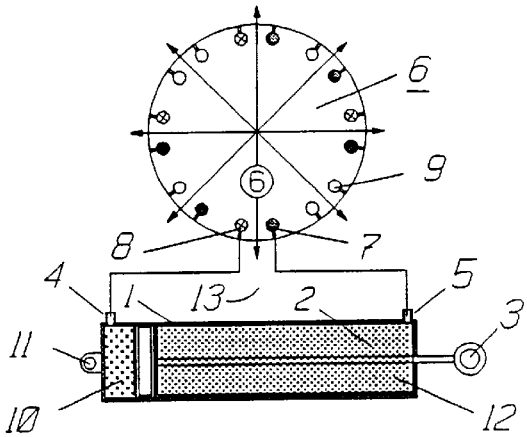

In a double acting cylinder the function of the piston, during the reversing of the working direction is split into eight different phases, namely, starting from a full speed working phase in one direction:

A. a full speed working phase in a first direction (→), during which the piston is moved in a predetermined direction (e.g. as shown in FIG. 1);
B. a soft stopping phase (FIG. 2) during which the piston movement is softly braked to stop;
C. an equalizing and reversing phase (FIG. 3), during which the two pressure chambers are subjected to the same pressures;
D. a soft starting phase (FIG. 4) during which the piston starts moving in the opposite direction (←) against a slight counter pressure which is successively reduced to atmospheric pressure;
E. a full speed working phase (FIG. 5) at full pressure in said opposite direction (←);
F. a soft stopping phase (FIG. 6) during which the piston movement is softly braked to stop;
G. an equalizing and reversing phase (FIG. 7), during which the two pressure chambers are subjected to the same pressures;

H. a soft starting phase (FIG. 8) in a reversed direction during which the piston starts moving in said first direction (→) against a slight counter pressure which is successively reduced to atmospheric pressure.

The function is illustrated in the following table 1:

TABLE 1

(reversible power type)

| phase | shown in FIG. nr | left chamber pressure (P) | right chamber pressure (P) | actual function of the phase | next phase |
|---|---|---|---|---|---|
| A | 1 | full P | 0 | full speed → | soft stopping → |
| B | 2 | full P | choking ↓ | soft stopping → | stop/ reverse |
| C | 3 | 0 | 0 | stop/ reverse ⊃ | soft starting ← |
| D | 4 | choking ↑ | full P | soft starting ← | full speed ← |
| E | 5 | 0 | full P | full speed ← | soft stopping ← |
| F | 6 | choking ↓ | full P | soft stopping ← | stop/ reverse ⊂ |
| G | 7 | 0 | 0 | stop/ reverse ⊂ | soft starting ← |
| H | 8 | full P | choking ↑ | soft starting → | full speed → |

In a single acting pneumatic cylinder the above mentioned shunt power can, according to the invention, be used as a return power for the piston by draining the power of the former pressure side. To this end there is used a four-stage valve means having four positions providing five functional phases. The function thereof is illustrated in the following table 2:

TABLE 2

(single acting power type)

| phase | shown in FIG. nr | left chamber pressure (P) | right chamber pressure (P) | actual function of the phase | next phase |
|---|---|---|---|---|---|
| A | 12 | full P | 0 | full speed → | soft stopping → |
| B | 13 | 0 | 0 | no power supply | equalization |
| C | 14 | P/2 | P/2 | stop/reverse ⊃ | return starting ← |
| D | 15 | 0 | P/2 | return mov. ← | soft starting → |
| E | 12 | full P | P/2 | soft starting → | full speed → |

Figure 7:
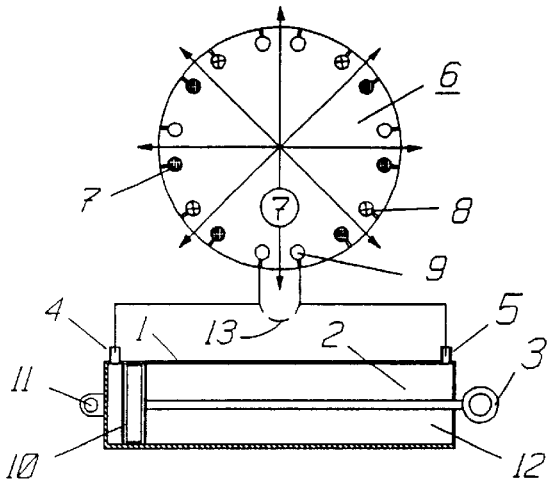
Figure 8:
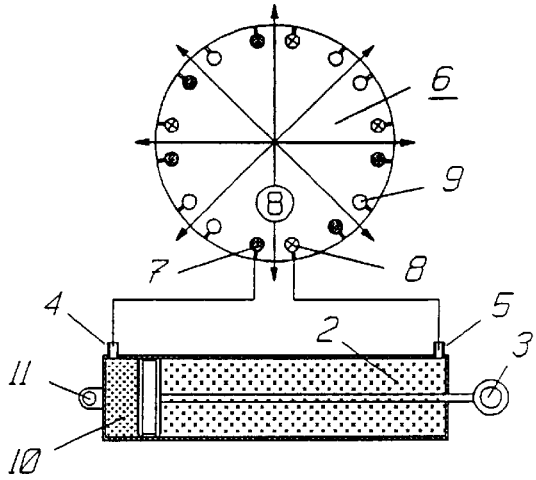
Figure 9:
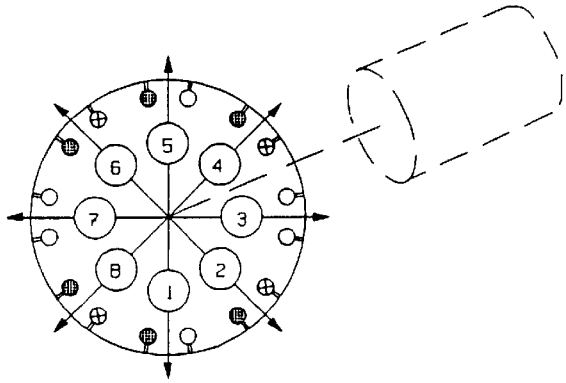
Figure 10:
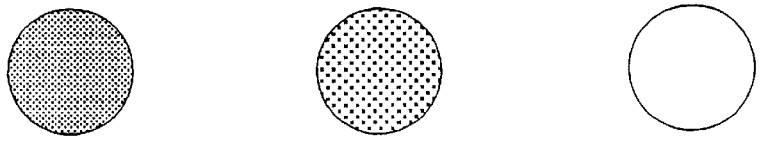
Figure 11:
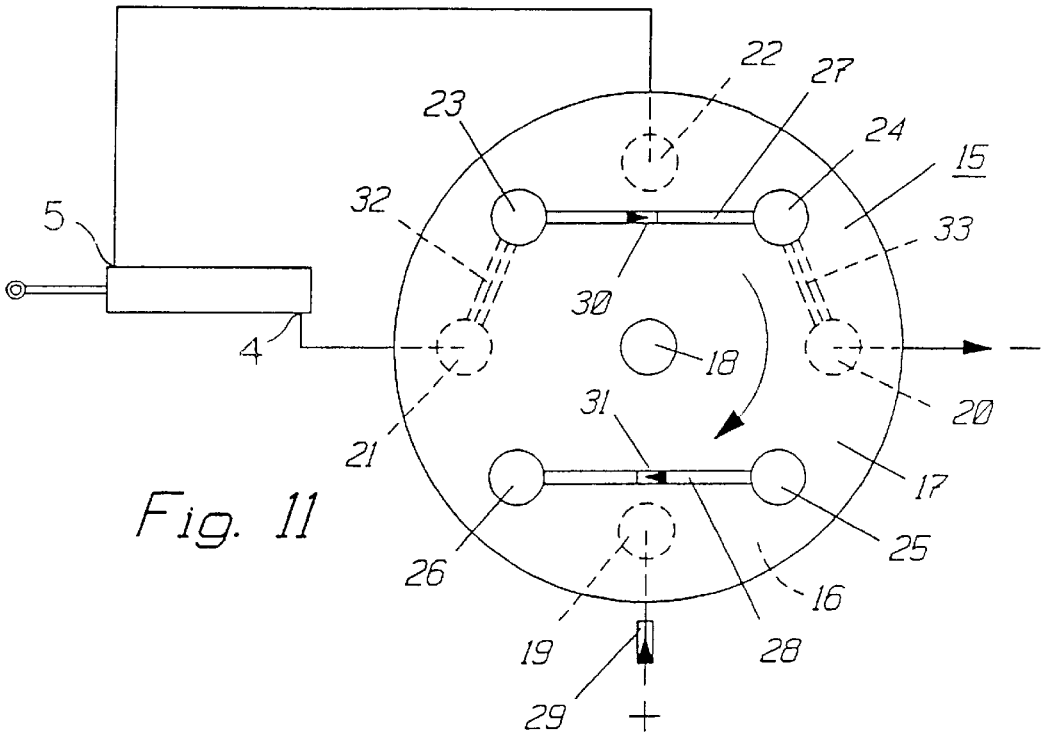
Figure 16:
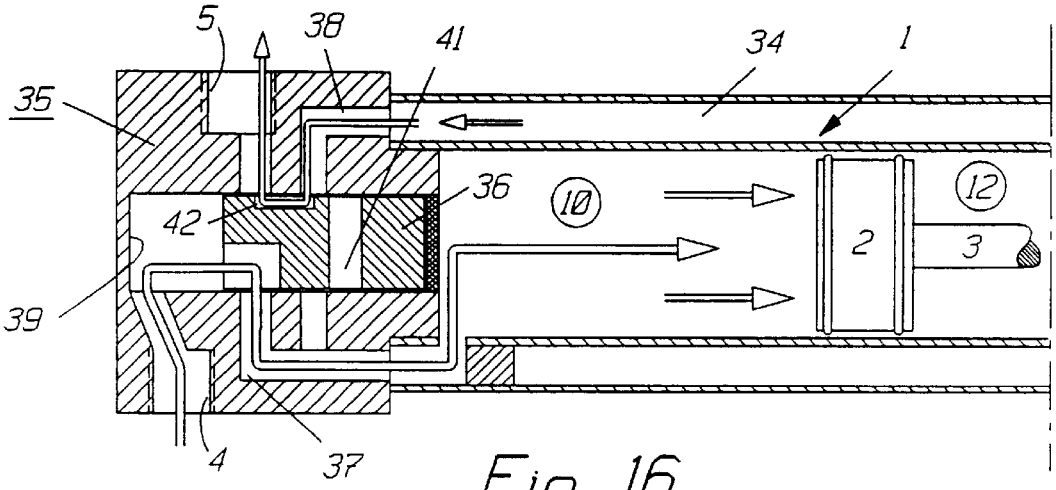
Figure 17:
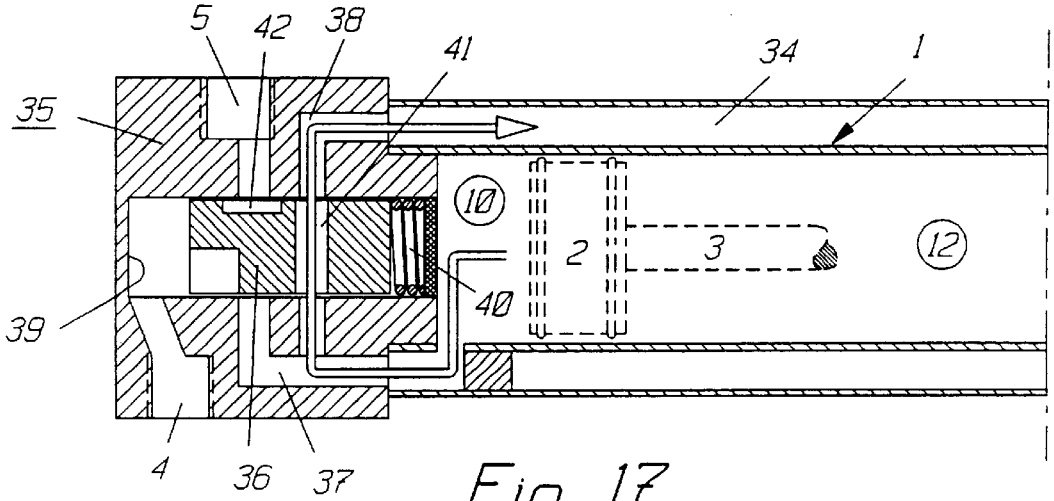
Figure 18:
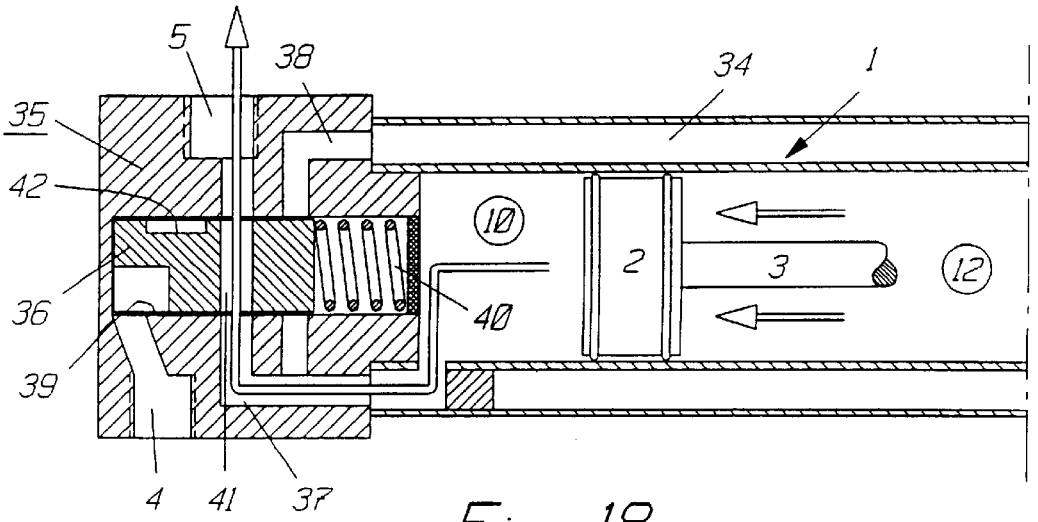

Now the invention is to be described in detail with reference to the accompanying drawings, in which FIGS. 1–8 show a sequence of the above mentioned eight functional phases for a double acting, reciprocatable pneumatic machine, in which FIG. 9 diagrammatically illustrates a rotatable valve for performing the soft stopping and soft starting function of the pneumatic or hydraulic power machine, and in which FIG. 10 illustrates pictures used for marking of the three pressures in FIGS. 1–8. FIG. 11 is a diagrammatical view of a 4-stage valve for performing the operation of a single power operation pneumatic machine, and FIGS. 12–15 diagrammatically illustrates the function thereof. FIGS. 16–18 illustrate an example of a pneumatic piston-cylinder unit for executing the method illustrated in FIGS. 12, 14 and 15, respectively.

The operation method of a reversible type power pneumatic or hydraulic piston-cylinder of the invention is explained in connection to the FIGS. 1–9 of the accompanying drawings, which diagrammatically show a piston/cylinder unit comprising a cylinder part 1 and a piston part 2 having a piston rod 3, connections 4 and 5 for a pneumatic or hydraulic pressure fluid at each end of the cylinder 1, and a valve 6 for creating the various functional phases of the apparatus.

The valve 6, which in the illustrated case is of rotatable type, but which may as well be of axially reciprocatable type, is formed with a pressure distributing means 7, a means 8 for providing a choking or a shunting of the pressure chambers of the power machine, for instance the piston-cylinder unit, valve, and a means 9 for evacuating the pressure chambers of the cylinder 1, 2. The valve is illustrated only with respect to the function thereof in FIGS. 1–9, be it obvious to the expert how to design the valve in order to obtain such functions.

During its operation the valve of FIGS. 1–9, in the illustrated case can take eight different active positions marked with letters A–H in FIGS. 1–8 respectively.

A. Working phase (direction ⇒), shown in FIG. 1:

We have chosen to start the description of the function in a valve position (FIG. 1) in which the piston chamber 10 at the stationary mounted side 11 of the cylinder 1 is under full working pressure. The pressure fluid connection 4 at said stationary end of the cylinder, is connected the pressure distribution means 7 of the valve 6 placing the outer piston chamber 10 is under full pressure. The piston (rod) chamber 12, which is now inactive, is drained in that the pressure fluid connection 5 at said side of the cylinder is open to the ambient via the evacuation means 9. The piston 2 is thereby forced with full power to the right as shown in FIG. 1.

Figure 2:
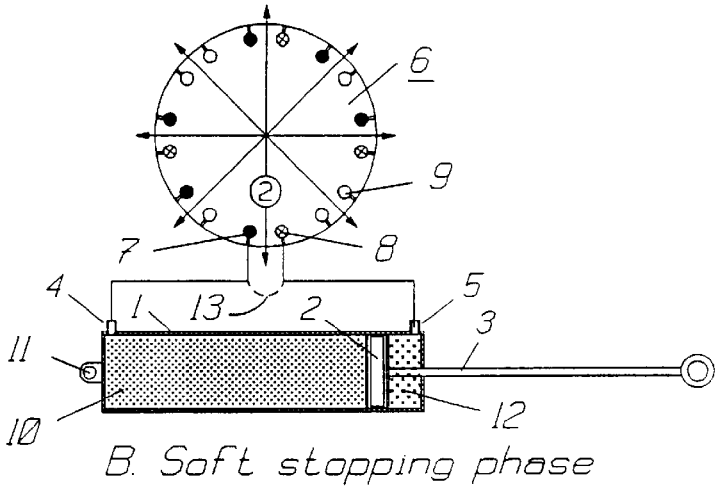
Figure 3:
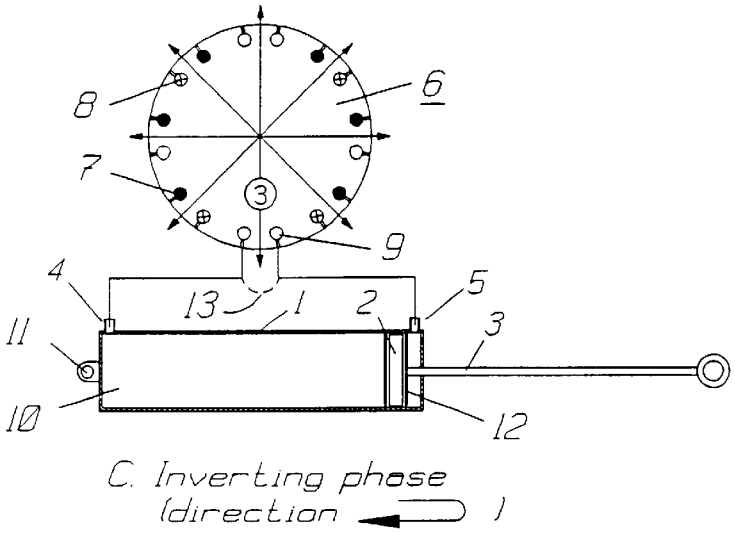

B. Soft stopping (equalization, direction ⇒) phase, FIG. 2:

After the valve 6 has been rotated a certain step (45° as illustrated in the drawings) in the clockwise direction, as shown in FIG. 2, the pressure fluid connection 4 is still under full pressure from the pressure distributing means 7. When the piston 2 approaches the piston rod end of the cylinder a counter force is applied to the piston rod chamber 12. There are basically two methods of providing such counter force:

a) to create a slight air or hydraulic pressure in the piston rod chamber 12 from the final movements of the piston 2 the choking means 8 is sufficiently (such as 100%) choked, which pressure is then stepwise or successively decreased, and concurrently therewith stepwise or successively decreasing the pressure in the outer piston chamber 10 so that the piston 2 is softly brought to stop;

b) for use in pneumatic machines, to break the air pressure to the outer piston chamber 10 and immediately thereupon to open a bypass or shunt 13 (marked with dotted lines in FIG. 2) between the outer piston chamber 10 and the piston rod chamber 12, whereby the pressure from the outer piston chamber 10 is distributed with equal force also to the piston rod chamber 12, whereby there is an equalization of pressure in said two chambers 10 and 12 and the piston 2 is softly brought to stop during the equalization.

C. Inverting phase (direction ⊃), FIG. 3:

In this third phase the valve 6 has rotated (45°), whereby both the outer cylinder chamber 10 and the piston rod chamber 12 are being blocked or are opened to the ambient over the evacuation means 9. Now the piston 2 is balanced from both sides and is ready to start moving in the opposite direction.

Figure 4:
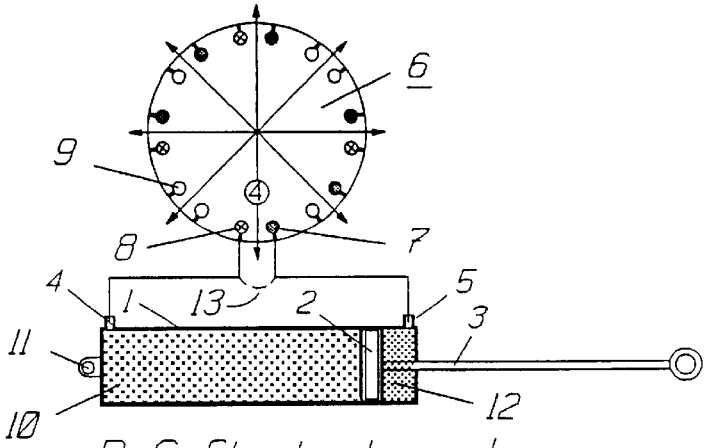

D. Soft starting phase (direction ⇐), FIG. 4:

The outer piston chamber 10; a) is connected to the choking means 8, whereby said chamber is closed and is thereupon stepwise or successively opened to the ambient, whereas the piston rod chamber 12 is subjected to full pressure, and this makes the piston start moving with a softly accelerated piston movement; or alternatively b) the piston chamber can be put under a slight, stepwise or successively decreased counter pressure over the choking means 8. In both cases the piston rod chamber 12 is connected to the pressure distributing means 7 supplying full pressure to the piston rod chamber 12. The pressure of the piston rod chamber 12 is higher than the pressure of the outer piston chamber 10, and the piston softly starts moving to the left, as shown in FIG. 4. The pressure gradient is stepwise or successively increasing to maximum pressure following the decrease of the choking pressure in the outer pressure chamber 10.

E. Working phase (direction ⇐), FIG. 5:

In this fifth phase the valve poppet 6 has rotated so that the cylinder chamber 12 is put under full pressure over the pressure means 7, and the outer piston chamber 10 is drained to the ambient, whereby the piston moves at full pressure and full speed to the left.

F. Soft stopping phase (direction ⇐), FIG. 6:

In this phase the same process as that of point B above is repeated, but with the piston moving in the opposite direction. The outer piston chamber 10 is connected to the choking means 8, or the pressure of the piston rod chamber 12 is distributed to the outer piston chamber 10. Thereby the piston 2 is softly brought to stop.

G. inverting phase (direction ⊂), FIG. 7

In this phase the same process is repeated as that of step C above but with the piston being prepared for moving from left to right (⊂).

H. Soft staring phase (direction ⊂), FIG. 8:

In this phase the same process is repeated as that of step D above but with the piston softly staring to move to the right as shown in FIG. 8. Thereby a complete operation cycle is ended and the cycle is repeated from point A above.

In FIG. 9 it is indicated that the valve 6 can be connected to a motor (depicted in phantom), which can be an electrical or pneumatical motor, for instance a stepping motor and which can operate the cylinder-piston unit successively until the operation is to cease. The stepping motor can be arranged to provide any desired number of small steps, e.g. from 10–200 steps per 360° rotation. The valve can be rotated stepwise or continuously and by different speeds depending on what function is desired from the cylinder-piston unit.

By choking or breaking the pressure supply to the piston chambers 10, 12 it is also possible to make the piston 2 stop and remain still standing in any position in the cylinder 1 between the end positions, thereby avoiding such "creeping" which can generally not be avoided in pneumatic machines of conventional type.

In pneumatical power machines it is often difficult to stop the working movement in a predetermined position for the piston, among other things depending on the compressibility of the air. According to the invention this problem is solved in a pneumatic or hydraulic apparatus or the above described type in that the deceleration and the stopping of the piston movement is made in several successive steps with successively or stepwise reduced pressure differences between the working side of the piston and the evacuated side of the piston. This can simply be made by forming the valve means so as to successively or stepwise choke the evacuation of the evacuated side of the piston, for instance by a choking in four or more steps, like from 100% to 50% to 25% to 0% pressure choking. Said choking can be accomplished in various ways, as obvious to the expert, for instance in that evacuation bores or pressure restriction valves can be provided in the valve poppet in such positions and are formed such as to successive or stepwise choking of the piston, starting when the piston has reached a certain position in the cylinder.

Thus, a first choking can be provided to 50% pressure difference between the two piston chambers 10, 12 when there is only about 50 mm left of the piston race, a second choking to 25% pressure difference when there is 10 mm left of the piston race, and a choking to 0% pressure difference when there is only one or two mm left of the piston race. The said last mentioned "choking step" follows as an addition step after the working phases according to FIGS. 2 and 6.

In FIG. 11 there is diagrammatically shown a 4-stage valve 15 which is mainly useful for controlling the operation of single power operated pneumatic machines, like cylinder-piston units. The 4-stage function of an equivalent sliding value 36, including the air return movement is shown in FIGS. 12–15.

Conventional pneumatical cylinders of this type generally are formed with a return spring means, at the piston rod chamber side, which makes the piston return to the stationary side of the cylinder after having performed a working phase.

The present valve, which can be mounted at the end of the cylinder, or elsewhere, provides a function eliminating the need of a return spring as used in conventional one power stroke pneumatic cylinders. The valve is formed with two discs, a bottom disc 16 and a top disc 17. The bottom disc 16 is stationary and the top disc 17 is rotatable around a pin 18 in relation to the bottom disc. The bottom disc is formed with four connections, an air pressure power supply connection 19, a draining supply connection 20, a connection 21 to the outer piston chamber and a connection 22 to the piston rod chamber. The top disc 17 is likewise formed with four connections 23, 24, 25 and 26 provided similarly to the bottom disc connections. Between the connections 23 and 24 there is a bypass 27, and between the connections 25, 26 there is a bypass 28. The supply connection 19 is formed with a one-way valve 29 allowing flow of fluid only into said connection. In the bypass 27 there is a one-way valve 30 allowing flow of fluid only in the direction 23 to 24, and in the bypass 28 there is a one-way valve 31 allowing flow of fluid only in the direction 25 to 26. Further there is a first bypass 32 between the outer piston chamber connection 21 in the bottom disc 16 and the connection 23 of the top disc 17 and a second bypass 33 between the connections 20 and 24.

The valve 15 makes is possible to make use of an equalization pressure as piston return power. Also in this embodiment there is a soft stopping function and a soft starting function. The function is the following:

Complete stop, FIG. 11

With the valve discs 16, 17, as shown in FIG. 11 there is no supply of power from the connection 19; the piston rod connection 5 is closed, and the outer piston chamber connection 4 is drained.

Figure 12:
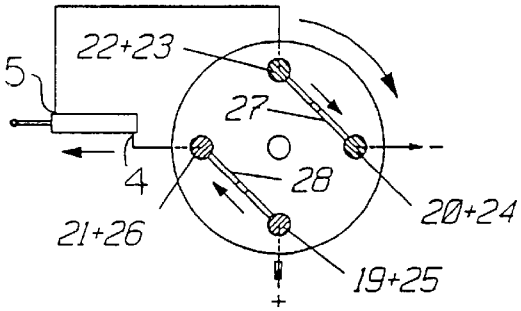

Power stroke, FIG. 12

After rotating the top disc 17 (in this case 45°) the top connection 25 is in line with the power supply 19, and the top connection 26 is in line with bottom disc connection 21. Thereby compressed air is—by a successively or stepwise increased pressure gradient—supplied to the outer piston chamber connection 4 via the bypass 28. The piston rod chamber connection 5 is open to the ambient over the connections 22, 23, 24 and 20 via the bypass 27.

Figure 13:
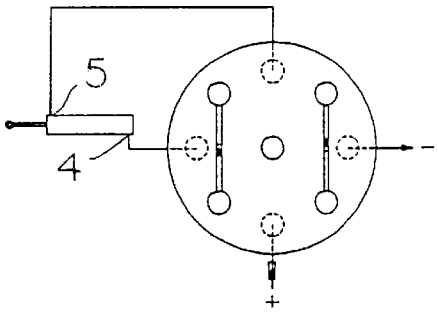

Intermediate stop position, FIG. 13

At the end of the power stroke the top valve disc 17 is momentarily rotated to the position shown in FIG. 13, whereby the all bottom connections and top connections are separated from each other. The piston movement is thereby slightly dampened depending on the compressibility of the air in the cylinder chambers connections 4 and 5. The said intermediate stop position follows during a very short period of time, for instance only a few parts of a second.

Figure 14:
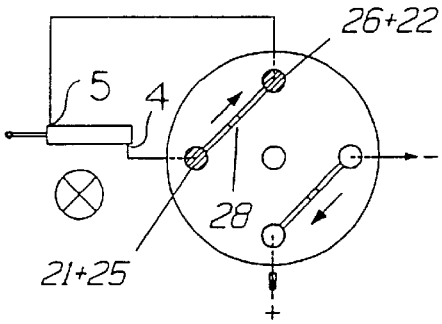

Equalization position, FIG. 14

After a very short while the top disc 17 is rotated to the position shown in FIG. 14, in which position the power supply 29 is blocked by the one-way valve 30 in the bypass 27; the drain connection 20 is open to the ambient; the outer cylinder chamber connection 4 is directly connected to the piston rod chamber 5 over the connections 21, 25, the bypass 28 and the connections 26, 22. Thereby the pressure from the outer piston chamber connection 4 is distributed also to the piston rod chamber 5, and the piston movement is thereby softly brought to stop. A pressure equalization is obtained between the two piston chambers 4 and 5.

Figure 15:
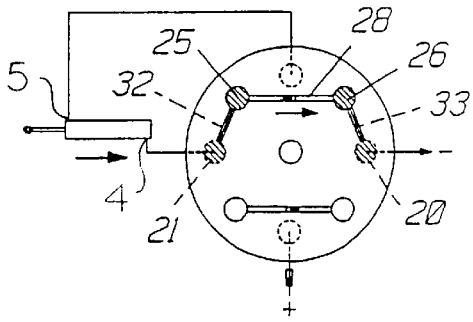

Return stroke, FIG. 15

After rotating the top disc 17 another step (45°) the situation appears which is shown in FIG. 15, and in which the outer piston chamber connection 4 is opened to the ambient over the bottom disc connection 21, the bypass 32, the top disc connection 25, the bypass 28, the top disc connection 26 the bypass 33 and the drain connection 20. The piston rod chamber 5, which is blocked by the top disc connection 22, is still under the part pressure obtained during the equalization step. Said pressure is sufficient for returning the piston to its original position adjacent the stationary end of the cylinder. Therefore the piston softly starts moving to the right, as shown in FIG. 15. The pressure successively decreases in the piston rod chamber connection 5 following the advancement of the piston, and as a consequence the return speed of the piston successively decreases thereby providing a soft stopping of the piston adjacent the stationary end of the cylinder. Thereby a complete operation cycle has come to an end.

FIGS. 16–18 are fragmentary cross section views in the axial direction of one end of a piston-cylinder unit for executing the single power stroke as illustrated in FIGS. 12, 14 and 15, respectively. In the illustrated piston-cylinder unit both connections 4 and 5 for the inlet and outlet of air are arranged at the same end of the piston. The flow of air from the piston rod chamber 12 goes through channels 34 at the periphery of the cylinder 1. The end head 35 of the cylinder is formed with a valve poppet 36 and with a passageway system 37, 38 allowing both inlet of pressurised air, at inlet 4, into the piston chamber 10 and outlet of air from the piston rod chamber 12, through outlet 5.

The end head 34 is formed with a first passageway 37 communicating the air inlet 4 with the piston chamber 10 and a second passageway 38 communicating the piston rod chamber 12 with the outlet 5 over the peripheral channel 34. The valve poppet 36 is slidable in a cylinder chamber 39 in the head 35 and can take two different main positions, a pressure position shown in FIG. 16, which corresponds to the valve position of FIG. 12, and a non-pressure position which is shown in FIG. 18, and which corresponds to the valve position of FIG. 15. The valve poppet 36 is biassed by a spring 40 towards its non-pressurised position. The valve poppet is also formed with a cross channel 41 which in an intermediate position of the valve poppet 36 communicates the main piston chamber 10 with the piston rod chamber 12 thereby balancing the air pressure between said two chambers 10 and 12. In said intermediate position the valve poppet 36 blocks the pressure channel 37 and the drain channel 38. This intermediate position, which is taken during a very short moment of the return stroke of the valve poppet 36 is shown in FIG. 17. This situation corresponds to the valve setting shown in FIG. 14. The valve poppet 36 also is formed with a bypass channel 42 allowing a draining of the piston rod chamber 12 in the pressure position of the valve poppet 36.

In FIG. 16 is shown that the inlet 4 is pressurised. The air pressure forces the valve poppet 36 to the right, whereby compressed air is supplied to the main piston chamber 10; at the same time the return channel 34 from the piston rod chamber 12 is communicated with the bypass channel 42, and the piston 2 is freely moved to the right corresponding to the valve setting shown in FIG. 12.

After the piston 2 has been stopped softly at the end of its stroke and there is no pressure in the inlet 4 or the outlet 5 the spring 40 forces the valve poppet 36 back towards its base position. While moving to the left the cross channel 41 connects the air passageways between the two chambers 10 and 12 to each other for a short moment, as shown in FIG. 17. The former air pressure in the main chamber 10 is thereby transmitted to the piston rod chamber 12 over the cross channel 41, part of the end head passageway 38 and the "return" channel 34. In this position both the inlet 4 and the outlet 5 are blocked by the valve poppet.

When the valve poppet 26 has been returned to its initial position, as shown in FIG. 18 the air pressure in the main chamber 10 is drained over the passageway 37, the cross channel 41 and the outlet 5. The "balanced" pressure still existing in the piston rod chamber 12 is sufficient for softly forcing the piston 2 back to its starting position adjacent the end head 35.

Thereby a complete operation cycle is ended. Like in FIGS. 11–15 there is no need for a return spring or any other means for returning the spring in the illustrated one-way power pneumatic cylinder-piston unit.

What is claimed is:

1. A method of controlling the function of a reciprocatable power machine having a reciprocatable piston located between first and second pressure chambers, said method comprising the steps of:

moving the piston in an active power stroke from an end of a then active first pressure chamber to an end of a then inactive second pressure chamber by supplying a pressure fluid at a full power pressure to the then active first pressure chamber;

building up a stopping counter pressure in the then inactive second pressure chamber as the piston approaches the end of the then inactive second pressure chamber to counter-act the full power pressure of the pressure fluid in the then active first pressure chamber;

decreasing of the stopping counter pressure in the then inactive second pressure chamber to a positive final stopping counter pressure as the piston reaches the end of the then inactive second pressure chamber so that the piston is softly stopped at the end of the then inactive second pressure chamber against the final stopping counter pressure;

utilizing the final stopping counter pressure to start an active return power stroke of the piston from the end of a then active second pressure chamber;

supplying the pressure fluid at a full power pressure to the then active second pressure chamber after said utilizing step to move the piston in said active return power stroke from an end of the then active second pressure chamber to an end of a then inactive first pressure chamber;

providing a starting counter pressure in the then inactive first pressure chamber as the piston starts to move from the end of the then active second pressure chamber to counter-act the full power pressure of the pressure fluid in the then active second pressure chamber, said providing a starting counter pressure step including the steps of the controlled opening of the then active first pressure chamber to ambient to fully vent the full power pressure of the pressure fluid as the piston approaches the end of the then inactive second pressure chamber, and the closing of the then inactive first pressure chamber to ambient as the full power pressure fluid is supplied to the then active second pressure chamber and the piston starts to move; and decreasing of the starting counter pressure in the then inactive first pressure chamber as the piston leaves the end of the then active second pressure chamber so that the piston is softly started at the end of the then active second pressure chamber, wherein said decreasing of the starting counter pressure step includes the step of venting the counter pressure in the then inactive first pressure chamber to ambient.

2. A method of controlling the function of a reciprocatable power machine as claimed in claim 1:

wherein said decreasing of the stopping counter pressure step commences at a point where the piston has completed about 95% of the active power stroke.

3. A method of controlling the function of a reciprocatable power machine as claimed in claim 1:

and further including the step of reducing the full power pressure of the pressure fluid in the then active first pressure chamber as the piston reaches the end of the then inactive second pressure chamber concurrently with of the decreasing stopping counter pressure in the then inactive second pressure chamber.

4. A method of controlling the function of a reciprocatable power machine as claimed in claim 1:

wherein said decreasing of the starting counter pressure step is completed at a point where the piston has completed about 5% of the return stroke.

5. A method of controlling the function of a reciprocatable power machine as claimed in claim 1:

wherein said decreasing of the starting counter-pressure step includes the controlled opening of the then inactive first pressure chamber to ambient.

6. A method of controlling the function of a reciprocatable power machine as claimed in claim 1:

and further including the step of increasing the pressure of the pressure fluid in the then active second pressure chamber to full power pressure as the piston leaves the end of the then active second pressure chamber concurrently with the decreasing starting counter pressure in the then inactive first pressure chamber.

7. A method of controlling the function of a reciprocatable power machine as claimed in claim 1:

wherein said decreasing of the stopping counter pressure step is performed stepwise.

8. A method of controlling the function of a reciprocatable power machine as claimed in claim 1:

wherein said decreasing of the stopping counter pressure step is performed successively.

9. A method of controlling the function of a reciprocatable power machine as claimed in claim 1:

wherein said decreasing of the starting counter pressure step is performed stepwise.

10. A method of controlling the function of a reciprocatable power machine as claimed in claim 1:

wherein said decreasing of the starting counter pressure step is performed successively.

11. A method of controlling the function of a reciprocatable power machine as claimed in claim 1:

wherein said decreasing step decreases the stopping counter pressure in four steps corresponding to a pressure difference of 50%, 25%, 5%, and 0% of the full power pressure.

12. An apparatus for controlling the function of a reciprocatable power machine comprising:

a cylinder having a reciprocatable piston located therein and dividing said cylinder into first and second pressure chambers; and a valve system which controls fluid pressures in said first and second pressure chambers, said valve system including a valve poppet having a plurality of channels in order (a) to provide a full power pressure fluid to said first pressure chamber to move said piston in an active power stroke from an end of a then active said first pressure chamber to an end of a then inactive said second pressure chamber and to provide an evacuation of the pressure fluid from the then inactive said second pressure chamber, and (b) to provide an evacuation of the pressure fluid from the then inactive said first pressure chamber when said piston moves in a return stroke, a building up means for building up a stopping counter pressure in the then inactive said second pressure chamber as said piston approaches the end of the then inactive said second pressure chamber to counter-act the full power pressure of the pressure fluid in the then active said first pressure chamber, a decreasing means for decreasing the stopping counter pressure in the then inactive said second pressure chamber to a positive final stopping counter pressure as said piston reaches the end of the then inactive said second pressure chamber so that said piston is softly stopped at the end of the then inactive said second pressure chamber against the final stopping counter pressure, a starting means for utilizing the final stopping counter pressure to start the return stroke of said piston from the end of a then active said second pressure chamber, a supply means for supplying the pressure fluid at a full power pressure to the then active said second pressure chamber after said starting means has started the return stroke of said piston to move said piston in an active return power stroke from an end of the then active said second pressure chamber to an end of a then inactive said first pressure chamber, a second starting means for providing a starting counter pressure in the then inactive said first pressure chamber as said piston starts to move from the end of the then active said second pressure chamber to counter-act the full power pressure of the pressure fluid in the then active said second pressure chamber, and a second decreasing means for decreasing of the starting counter pressure in the then inactive said first pressure chamber as said piston leaves the end of the then active said second pressure chamber so that said piston is softly started at the end of the then active said second pressure chamber;

wherein said first-mentioned starting means further controls an opening of the then active said first pressure chamber to ambient to fully vent the full power pressure of the pressure fluid as said piston approaches the end of the then inactive said second pressure chamber, and closes the then inactive said first pressure chamber to ambient as the full power pressure fluid is supplied to the then active said second pressure chamber and said piston starts to move; and wherein said decreasing means vents the counter pressure in the then inactive said first pressure chamber to ambient.

13. An apparatus for controlling the function of a reciprocatable power machine as claimed in claim 12:

wherein said first mentioned decreasing means commences at a point where said piston has completed about 95% of the active power stroke.

14. An apparatus for controlling the function of a reciprocatable power machine as claimed in claim 12:

wherein said valve system further includes a reducing means for reducing the full power pressure of the pressure fluid in the then active said first pressure chamber as said piston reaches the end of the then inactive said second pressure chamber concurrently with the decreasing stopping counter pressure in the then inactive said second pressure chamber.

15. An apparatus for controlling the function of a reciprocatable power machine as claimed in claim 12:

wherein said second decreasing means completes the decreasing of the starting counter pressure step at a point where said piston has completed about 5% of the return active power stroke.

16. An apparatus for controlling the function of a reciprocatable power machine as claimed in claim 12:

wherein said second decreasing means controls an opening of the then inactive said first pressure chamber to ambient.

17. An apparatus for controlling the function of a reciprocatable power machine as claimed in claim 16:

wherein said valve system further includes a second increasing means for increasing the pressure of the pressure fluid in the then active said second pressure chamber to full power pressure as said piston leaves the end of the then active said second pressure chamber concurrently with the decreasing starting counter pressure in the then inactive said first pressure chamber.

18. An apparatus for controlling the function of a reciprocatable power machine as claimed in claim 12:

wherein said decreasing means decreases the stopping counter pressure in four steps corresponding to a pressure difference of 50%, 25%, 5%, and 0% of the full power pressure.

* * * * *

UNITED STATES PATENT AND TRADEMARK OFFICE

CERTIFICATE OF CORRECTION

PATENT NO. : 6,129,001
DATED : October 10, 2000
INVENTOR(S) : B. HARJU

It is certified that error appears in the above-identified patent and that said Letters Patent is hereby corrected as shown below:

Title page item
[22] PCT Filed: Oct. 2, 1995

Signed and Sealed this

Twenty-fourth Day of April, 2001

Nicholas P. Godici

*Attest:*

NICHOLAS P. GODICI

*Attesting Officer*

*Acting Director of the United States Patent and Trademark Office*